US007827667B2

(12) United States Patent
Yu et al.

(10) Patent No.: US 7,827,667 B2
(45) Date of Patent: Nov. 9, 2010

(54) PACKAGING AND PRESENTATION OF SMALL HARDWARE

(75) Inventors: Young Chee Yu, Perak (MY); Ming-Goei Sheu, Cupertino, CA (US)

(73) Assignee: ESGW Holdings Limited, Tortola (VG)

( * ) Notice: Subject to any disclaimer, the term of this patent is extended or adjusted under 35 U.S.C. 154(b) by 0 days.

(21) Appl. No.: 12/384,741

(22) Filed: Apr. 8, 2009

(65) Prior Publication Data

US 2009/0199387 A1 Aug. 13, 2009

Related U.S. Application Data

(62) Division of application No. 11/047,118, filed on Jan. 31, 2005, now Pat. No. 7,520,385.

(51) Int. Cl.
*B23P 19/04* (2006.01)
*B65D 85/24* (2006.01)

(52) U.S. Cl. ..... 29/423; 206/347

(58) Field of Classification Search ..... 29/428, 29/429, 423, 413; 206/347, 338–346, 445, 206/459.5, 820; 411/442–444
See application file for complete search history.

(56) References Cited

U.S. PATENT DOCUMENTS 3,211,284 A * 10/1965 Anstett ..... 206/346
3,661,251 A * 5/1972 Waeltz ..... 206/346
3,707,226 A * 12/1972 Wippermann ..... 206/490
4,955,476 A * 9/1990 Nakata et al. ..... 206/346
5,544,746 A * 8/1996 Dohi ..... 206/346
5,811,717 A * 9/1998 Day et al. ..... 89/35.01
5,887,727 A 3/1999 Ames
5,984,096 A * 11/1999 Shinjo ..... 206/347
6,158,585 A 12/2000 Labat et al.

* cited by examiner

*Primary Examiner*—John C Hong
(74) *Attorney, Agent, or Firm*—Saile Ackerman LLC; Stephen B. Ackerman

(57) ABSTRACT

A packaging arrangement for smoothly and conveniently providing small hardware items to an assembly line operator is described. The items are fastened onto a flexible band, lined up in the order in which they are to be installed on an article being assembled. The band is divided into equal segments defined by index marks, each segment containing the hardware items required for the assembly of one article. The items are fastened to the band off-line using securing features fashioned from the band itself in a manner and orientation by which each item can be plucked from the band with a tool that can grasp the item, pull it off the band, transport it to the article being assembled, and install it on the article without intermediate disengagement from the tool. The utilization of the band improves the productivity and reliability of manually assembled articles such as disk drives.

12 Claims, 5 Drawing Sheets

PACKAGING AND PRESENTATION OF SMALL HARDWARE

This application is a Divisional of U.S. patent application Ser. No. 11/047,118, filed on Jan. 31, 2005 now U.S. Pat. No. 7,520,385, and herein incorporated by reference in its entirety.

BACKGROUND OF THE INVENTION (1) Field of the Invention

The invention relates to processes for the assembly line manufacture of articles and more particularly to the timely and orderly delivery of a plurality of small hardware components during the assembly of complex articles containing mechanical components.

(2) Background of the Invention and Description of Previous Art

It is well known that the productivity of an assembly line is strongly dependent on the timely and orderly delivery of components of the article being manufactured to the appropriate various stations of the assembly line. Complex articles containing electronic and mechanical components, such as computer storage disk drives, compact disc drives and the like, have additional assembly requirements, which include high degrees of cleanliness, ambient control, and careful handling of components.

Computer drives of all sorts typically consist of a mechanical drive mechanism to which at least one printed circuit board is attached and electrically connected. In the manufacture of these drives, the printed circuit board is typically populated with electronic components, on a placement machine which uses robotic arms to pick, place, and solder the components. Placement machines have a very high and flawless placement rate. On the other hand, the mechanical sub-assemblies to which the printed circuit board is connected, still require manual assembly by a line operator. The mechanical sub-assemblies utilize a plurality of small hardware parts such as screws, nuts, pins, gears, springs, micro switches, bearings, and the like which must be selected, oriented and then placed by an operator in a specified sequence. Finally, the mechanical sub assembly and corresponding printed circuit board(s) are manually assembled and mounted on a chassis and encased. These manual assembly operations are highly operator dependent and greatly limit productivity and reliability yield of the finished product. While limited volume and multiple part number considerations do not make total robotic assembly cost effective, it is nevertheless desirable to streamline the process by reducing the time spent by the operator in selecting, sequencing, and orienting the small hardware components on the assembly line. The present invention provides a method for accomplishing such a procedure and thereby improves the overall productivity as well as the reliability of the finished product.

For the purpose of the present invention small hardware is defined as mechanical components which individually weigh less than about 200 grams and have a longest dimension of less than about 10 cm. Articles fitting this definition include but are not limited to pins, gears, springs, studs, spacers, micro switches, nuts, bolts, screws, and bearings. Further, for the purpose of present invention, the definition of small hardware also excludes articles which are spherically shaped and which, being totally symmetric, do not require orientation for installation.

Conventionally, small hardware is packed randomly and arbitrarily in bags, boxes, or trays. The operator must first pick up a piece of hardware, by hand, determine its orientation, either visually or by feel, then orient it for installation, and finally install it on the assembly. These operations are not only time consuming but are also stressful to the operator, both physically and mentally, particularly under pressure of time. Further, hardware items, packed loosely tend to rub against each other in handling, thereby not only causing damage to the item but also creating particulate debris, which in a highly critical clean conditions, can seriously affect the reliability of the final product. The method and means of presentation of small hardware to the assembly line operator described by the present invention specifically addresses these issues and not only streamlines the manual assembly but also eases the burden on the line operator. Further, the method of the invention brings the small hardware installation a step closer to an automated process with minimal additional cost. This is due mainly to the ability to prepare the parts for presentation off-line.

Ames, U.S. Pat. No. 5,887,727 cites a method and means for sorting and funneling small hardware by the use of screens which are manually operated. The screens can be designed to parallel align and transport cylindrical objects such as pins or springs. However, an additional operation may be required to align screws with all the heads in one direction. Labat, et. al., U.S. Pat. No. 6,158,585 shows a dispenser of screws to an assembly line wherein a set of small hardware, notably of screws, all of the same type and size, is packaged on a holder consisting of a thin compartmented card having a lower break-away foil and covered with a transparent plastic layer in the form of a blister pack. Each holder is labeled and multiple holders, all consisting of the same screw, are prepared, and loaded into a cartridge which, in turn is loaded into a dispensing cabinet off-line. The holders are then manually extracted on-line, one at a time, through an opening in the bottom of the cabinet. If more than one type of screw is used, each screw type is packaged in its own cartridge and cabinet. Thus each dispensing cabinet, provided to the line assembler, contains only one type of screw.

SUMMARY OF THE INVENTION

It is an object of this invention to provide a packaging arrangement for smoothly and conveniently providing small hardware items to an assembly line operator.

It is another object of this invention to provide for improving the productivity and reliability of a manually operated mechanical assembly station.

It is yet another object of this invention to describe a packaging arrangement and manner of fastening small hardware items to a package substrate so that they may be easily and conveniently withdrawn from the packaging substrate oriented in a direction to be directly installed on an article being assembled by an assembly line operator without requiring any additional orientation by the operator.

These objects are accomplished by arranging small hardware parts on a dispensing substrate which consists of a flexible material such as a plastic, paper, or a smooth fibrous material. The parts are fastened onto the dispensing substrate in indexed sections and arranged in the order in which they will be installed on the article being assembled. Each of the parts are fastened onto the dispensing substrate in a manner so that they can be withdrawn from the substrate by the assembler, either by hand or preferably with a hand tool, grasping the part so that it is immediately oriented, in the hand or tool, towards the installation point. The dispensing package is prepared off-line and, depending on the number of items required by the assembly, may either be rolled up or fastened onto a rigid frame, The package is then loaded, either in a cartridge or individually into a cabinet wherein the sequential sections are presented to the line operator, one segment at a time.

DESCRIPTION OF THE PREFERRED EMBODIMENTS

In a first embodiment of this invention an indexed flexible small parts dispensing strip is described. The strip is indexed by punched holes or marks at constant intervals preferably near the long edge of the strip. The segments of the strip between two successive index holes or marks are fitted with retainment features which firmly hold a piece of small hardware on the strip. The position of piece of small hardware is held in an orientation on the strip in a direction that when presented to an assembly operator can be picked off the strip either by hand or with an appropriate tool, can be carried by the operator directly to its location on a unit being assembled without any further orientation by the operator.

Figure 1:
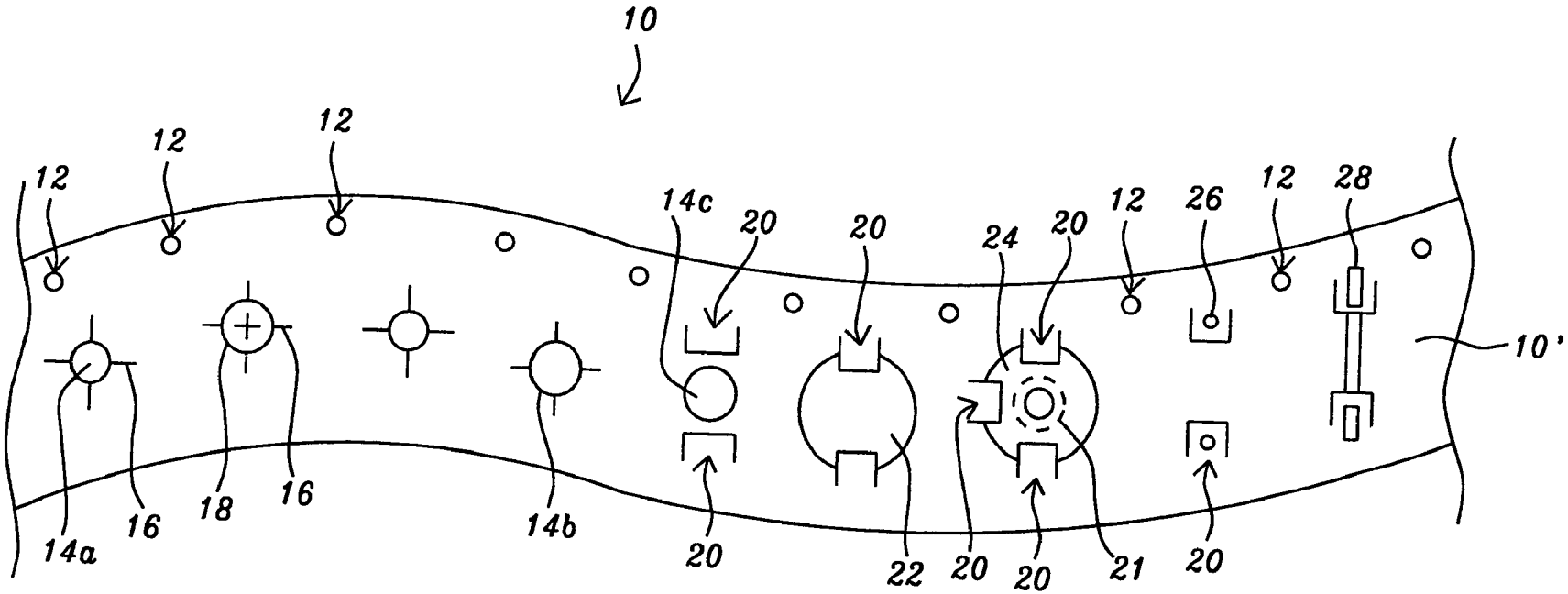
FIG. 1 is a top view of a segment of a flexible strip for holding small hardware arranged in a sequence and oriented for rapid, efficient, and reliable dispensing of and manual installation said hardware by an assembly line operator.

Referring to FIG. 1, there is shown a section 10' of a flexible strip 10 fitted with index holes 12, spaced at equal intervals along one edge of the strip 10. The flexible strip 10 is preferably made of a plastic material, for example, Mylar®, polyethylene, or polypropylene. Mylar® is a registered trademark of the E.I. duPont de Nemours Company. The index holes 12, as shown, are round and are formed by a hole punch. Alternately, the index holes may have another shape, for example square or rectangular. The index holes 12 may alternatively also consist of marks on the strip which can be read by a mechanism which advances the strip 10 to present a particular segment to the assembly operator. Alternately the holes or marks may be located in the center the strip 10 or on both sides of the strip 10. The region between two adjacent index holes/marks defines a segment of the strip. The small hardware items are mounted onto the segments of the strip in the order in which they will be picked and applied to an article being assembled by the online assembler. The hardware items are mounted onto the dispensing strip 10 by an offline operator. Each segment may only used in the assembly Each segment will be fitted with On the left side of the strip section 10' there is shown a feature 14*a* for the retainment of a screw. Screws are, by far, the most widely used small hardware item. The diameter of the punched circular hole 14*a* is just slightly smaller than the major diameter of the thread of the screw which is to be presented. The hole 14*a* is provided by at least two and preferably three or four relieves 16, which are slots cut preferably radially and evenly spaces around the hole 14*a*. The relieves 16 allow a screw (not shown) to be easily inserted and removed from the hole 14*a*, and firmly hold the screw in place during storage and handling of the strip 10. A Phillips head screw 18 is shown mounted on the strip 10 in the hole adjacent to hole 14*b*. To remove the screw 18 the operator inserts a crew retrieval tool, for example a screw holding (grasping) screwdriver and withdraws the screw 18, either by first pressing the screw through the strip 10 and then withdrawing the screw or by directly withdrawing the screw 18 from the strip 10. Feature 14*b* is simply an opening for a larger screw.

Feature 14*c* in FIG. 1 is a circular opening for holding a threaded or non-threaded stud. There are no relieves around this opening. Instead the opening 14*c* is made slightly large than the diameter of the stud shaft. A stud 22 is shown loaded in the adjacent opening. The stud 22 is inserted from the top while the two tabs 20 are spread apart from underneath and then released to hold the stud in place. The toughness and resiliency of Mylar® make it particularly well suited as a flexible substrate material when applied to form tabs. The stud 22 is withdrawn by the assembly operator by grasping the head, either with a tool or by hand, and pulling the stud away. Once withdrawn the stud 22 is oriented directly on the tool for mounting on the article being assembled.

Washers, spacers, bearings, gears, covers, and other circular and essentially flat items can be mounted on the strip 10 by using two, three, or four tabs 20. In FIG. 1 a washer 24 is held by three tabs 20 and can be withdrawn by the on-line assembler in the same manner as the stud 22, preferably by using a grasping tool or tweezers. Oftentimes it will be necessary to install a screw with washer combination onto an article. To facilitate this, the strip 10 is provided with an opening 21 (dashed circle) beneath the washer. The desired screw is first withdrawn from the strip, using a grasping tool. Then the screw is inserted through the washer 24 and opening 21 on the strip, the washer 24 is then grasped with the tool and the screw/washer combination is withdrawn from the strip. Mounting the screw/washer combination on the assembly article is again conducted with a smooth motion of delivery and placement since the item is already correctly positioned on the grasping tool for installation on the article.

Pins, and other straight items can by secured on the strip 10 using opposing tabs 20 each with a small punched hole 26. A pin 28 is shown in place in such a mounting. The pin 28 is withdrawn from the strip 10 by grasping one end of the pin 28 and pulling it off while lifting the tabs 20 up to free the pin. After the pin 28 is withdrawn, it is already in the proper grasping position to install it directly onto the assembly article.

All of the hardware items mentioned so far have been fastened to the flexible strip 10 by cutting, punching, or slitting the strip. Other small items which such as microswitches, springs, and other types of fasteners, may be best coupled to the strip 10 by clips fastened to the strip or by affixing certain compartments to the strip. The strip itself, providing it is not too long, may be supported by a frame, thereby making it tray-like. Further, in order to reduce the length of the strip, multiple items, such as small screws or washers, may be grouped into a single index segment. This would be the case, where a number of the same type of screw is used to fasten a cover onto the assembly. However, having more than one type or size of a component in the same index segment is dangerous and not recommended.

In a second embodiment of this invention, an article is assembled using small hardware supplied on a flexible stripe of the type described in the first embodiment. A hard disk data storage device will be assembled. All of the small hardware components will be provided on an indexed component strip having only eleven index segments. In addition to the hardware components, three sub-assemblies, namely the disk motor and spindle, the head sub-assembly, and a magnet sub-assembly are provided at the assembly station. A mounting chassis, a device populated printed circuit board with a plastic shield, and a top cover are also provided.

Figure 2:
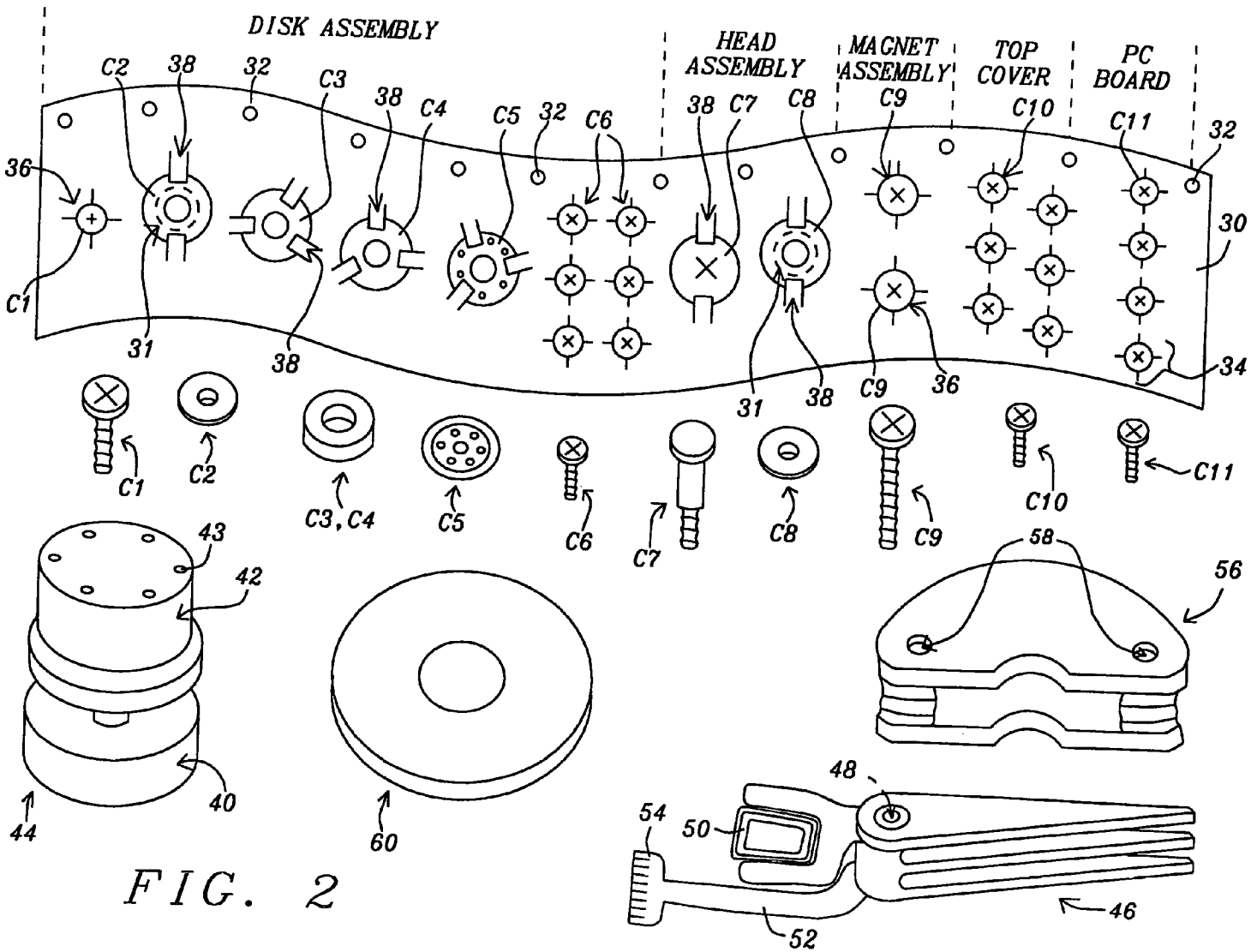
FIG. 2 is a top view of a flexible presentation strip, prepared according to the teaching of this invention, containing small hardware for assembly of a fixed disk magnetic data storage device wherein the pieces are arranged in indexed sections sequenced in the order of assembly and fastened to the strip in a manner that they can be withdrawn from the strip oriented toward installation on the article being assembled.

Referring to FIG. 2, a top view of the populated small hardware dispensing strip 30 is shown. The strip 30 is preferably made of a plastic material, for example, Mylar®, polyethylene, or polypropylene. Thirteen round index holes 32 are formed by a hole punch, defining eleven indexed component sections. Each segment is between about 5 and 8 cm. wide making the total length of the dispensing strip between about 55 and 90 cm. The dispensing strip 30 is between about 6 and 8 cm. wide. Alternately, the index holes may have another shape, for example square or rectangular. The index holes 32 may alternatively also consist of marks on the strip which can be read by a mechanism which advances the strip 30 to present a particular interval to the assembly operator. Alternately the holes or marks may be located on both sides of the strip 30. The hardware dispensing strip may be mounted on a frame or may be rolled up and placed in a presentation cabinet (not shown) wherein it will be presented one segment at a time to the assembler through an access opening on the top of the cabinet.

There are five types of screws (C1, C6, C9, C10, and C11) in the embodiment, all of which are mounted in round holes slightly smaller in diameter than the major diameter of the respective screw thread. Each screw hole has four relieves 34 formed by cutting four radial slots 36 at each hole as outlined in the first embodiment. Each screw is picked by the assembler, preferably using a grasping type screw driver. Thereby after extraction from the strip 30 each screw will be automatically be oriented for installation onto the assembly. The other items on the strip 30 consist of washers (C2, C8), spacers (C3,C4), a retainer/clamp (C5) and a threaded stud (C7). These items are secured on the hardware dispensing strip 30 by two or three tabs 38 cut into the strip as described in the first embodiment.

The items held on the dispensing strip 30 are also shown in isometric view directly below their position on the strip 30. Also illustrated in FIG. 2 are the three mechanical sub-assemblies which are provided separately to the operator at the assembly station. They are 1) a disk drive motor 40 and spindle 42 assembly 44; 2) a read/write head assembly 46 with bearing unit 48, coil 50, and wiring strap 52 with connector 54; and 3) a magnet sub-assembly 56 with mounting holes 58. Three magnetic storage disks 60 are also provided separately.

Figure 3:
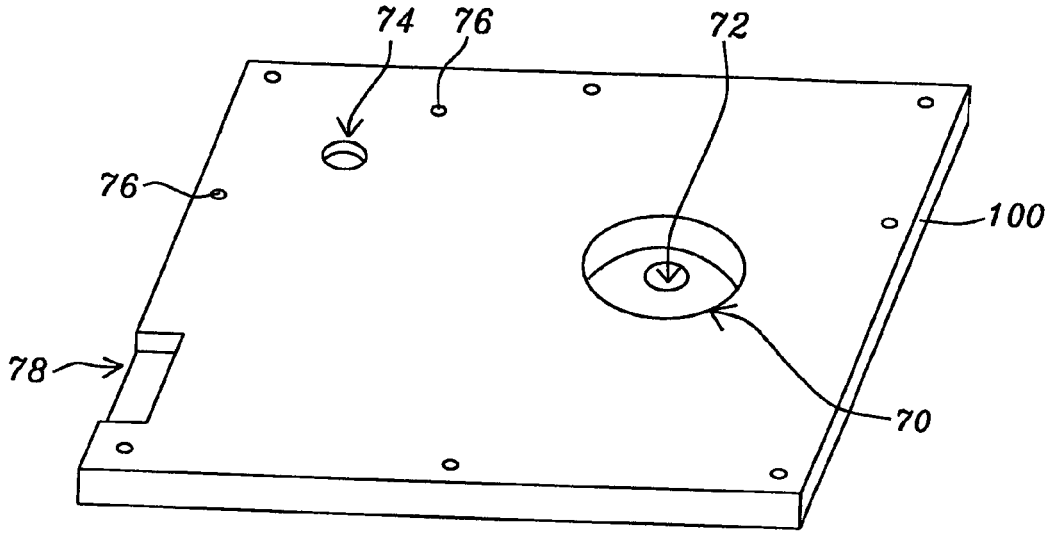
FIG. 3 through FIG. 7 are isometric drawings illustrating the assembly of a fixed disk drive magnetic data storage device using the indexed small hardware dispensing package described by the present invention.

Referring now to FIG. 3, there is shown an isometric view of a chassis or base plate onto which a fixed disk magnetic storage device will be assembled. The chassis 100 is provided with openings which will be identified as the components are installed. The disk drive motor 40 and spindle 42 sub-assembly 44 is first installed into the recessed opening 70 and secured by screw C1 and washer C2 in hole 72. The operator first places the unit 44 into the recess 70, then withdraws the screw C1 from the first segment of the dispensing strip 30 preferably using a grasping screw driver. Then the screw C1 is inserted through the washer C2 and strip opening 31. The washer C2 is then grasped with the tool and the screw/washer combination is withdrawn from the strip 30, and driven home into the base of the assembly 44. When the screw/washer C1/C2 combination has been withdrawn from the hardware dispensing strip 30, it is already oriented towards the assembly point.

Figure 4:
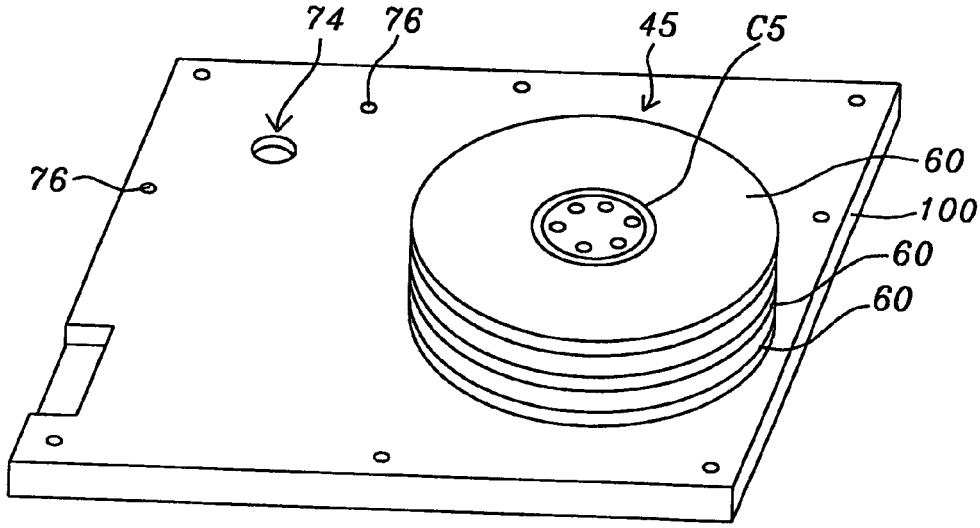

Referring, now to FIG. 4, the first storage disk 60 is picked and placed onto the spindle 42, preferably using a three prong pickup tool. The first spacer C3 is then pulled off the dispensing strip 30 and placed onto the spindle 42 using a similar three prong tool. A second disk 60 is then placed onto the spindle 42, followed by the placement of the second spacer C4 and a third disk 60. The retainer/clamp C5 is next withdrawn from the dispensing strip 30 using a tweezers or pickup tool and placed on the spindle 42 and fastened using the six screws C6 which are successively plucked from the dispensing strip 30 with a grasping screwdriver and immediately driven home into the threaded holes 43 in the top of the spindle 42 completing the assembly and placement of the disk drive sub-assembly 45.

Figure 5:
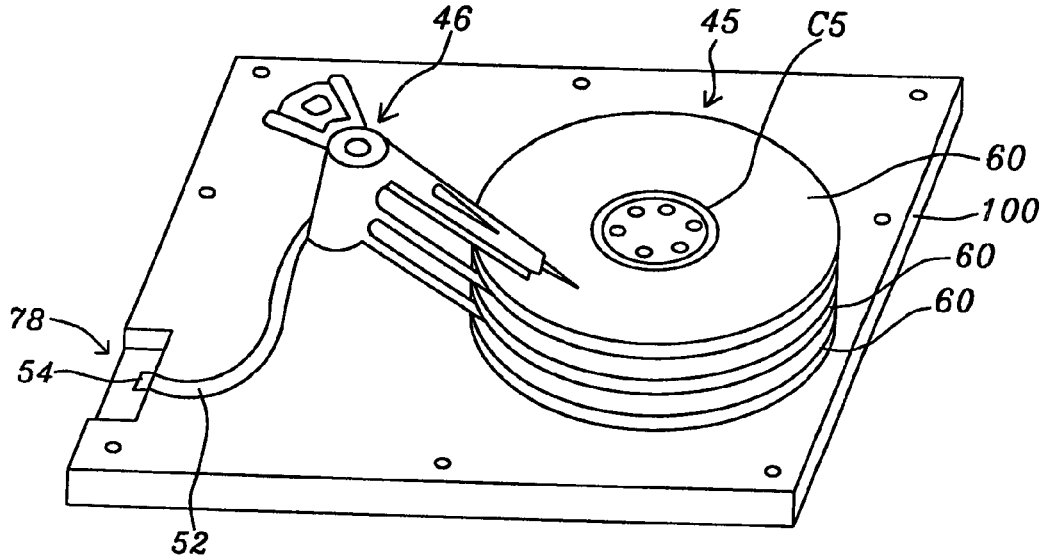

Referring now to FIG. 5, the read/write head sub-assembly 46 is positioned in opening 74 (see FIG. 3) of the base plate 100, The threaded stud C7 is next withdrawn from the dispensing strip 30, preferably using a grasping screwdriver, pulling it straight out, pushing it through the washer C8 on the strip, then grasping the washer C8 with the tool, and withdrawing both stud C7 and washer C8 from the strip. The stud and washer are then inserted into the opening 74 from below the chassis 100 and driven home into the bearing unit 48 of the head sub-assembly 46. The wiring harness 52 is then dressed over the base plate 100 and the end connector 54 fastened onto the base plate 100 in the recess 78.

Figure 6:
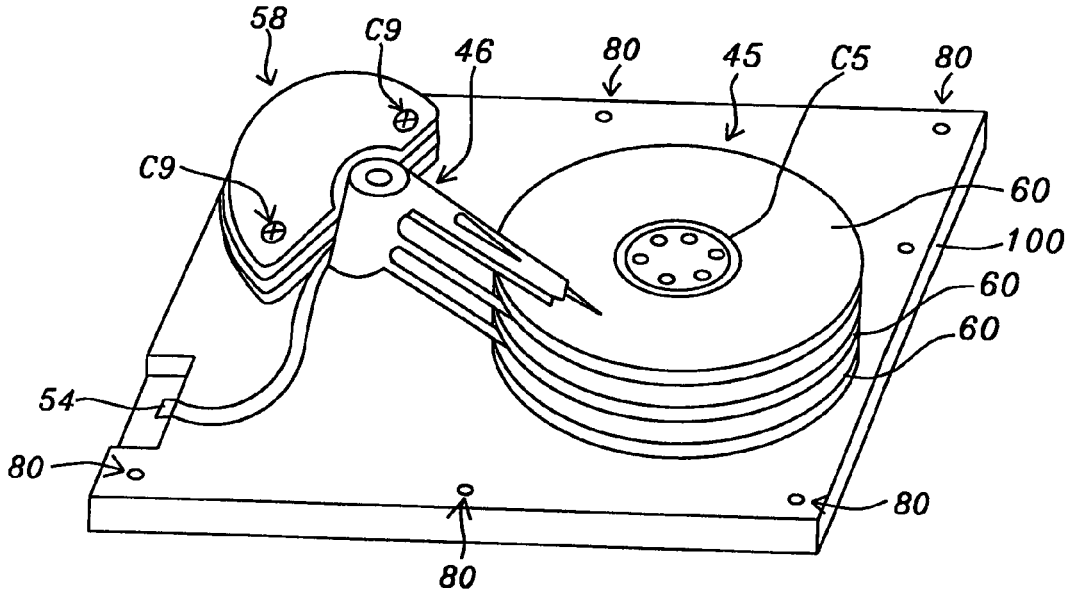
Figure 7:
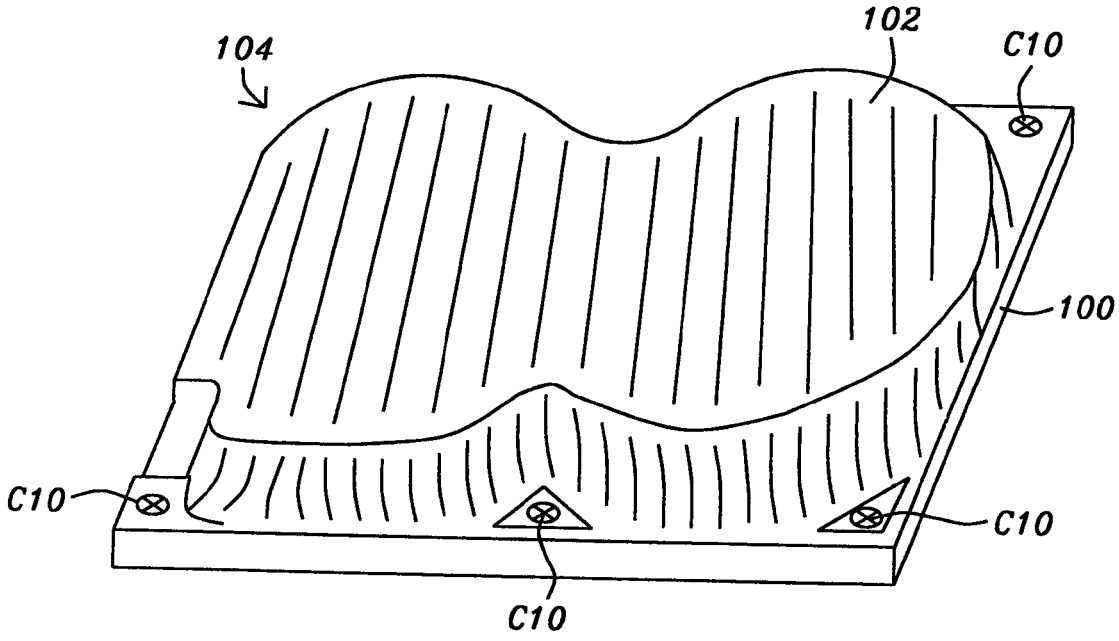

Referring now to FIG. 6 the magnet sub-assembly 56 is fastened to the base plate 100 with the two long screws C9 which are pulled, one at a time, from the dispensing strip 30, preferably with a grasping screwdriver, passed through openings 58 on the magnet sub-assembly, and driven into the threaded openings 76 (see FIG. 3). Again, the screws C9 are pulled from the dispensing strip 30 and driven home without the need of any additional orientation movements on the part of the assembler. This completes the assembly of the mechanical functions of the hard disk drive. Referring to FIG. 7, a cover 102 is next placed over the entire assembly and fastened with the six screws C10. In a final step, a populated printed circuit board (not shown) is next mounted onto the underside of the base plate 100 using the final 4 screws C11. The printed circuit board is then connected to the head connector 54 completing the assembly of the hard disk magnetic storage unit 104.

While this invention has been particularly shown and described with reference to the preferred embodiments thereof, it will be understood by those skilled in the art that various changes in form and details may be made without departing from the spirit and scope of the invention.

What is claimed is:

1. A method for assembling an article using oriented and sequenced small hardware presentation comprising:

(a) providing a small hardware dispensing substrate comprising:

(i) a flexible rectangular band having a plurality of index markings spaced at equal intervals along the length of said band, said markings defining a plurality of sequenced band segments; and (ii) means for fastening a plurality of small hardware items onto said band segments whereby each one of said plurality of hardware items is secured to said flexible rectangular band by a mounting feature cut into said band in each of said segments, in a manner and orientation by which every one of said items may be plucked from said band with a tool that can grasp any one or more of said items, pull said item off said band, transport said item to an article being assembled, and install said item onto said article without intermediate re-orientation or disengagement from said tool;

(b) offline populating said small hardware dispensing substrate with a plurality of small hardware items, fastening at least one of said plurality of small hardware items onto each successive band segment, in an order and orientation in which it is to be withdrawn and assembled onto a chassis, however, never allowing more than one type or size item in a single band segment, thereby forming a populated hardware dispensing substrate;

(c) online providing a chassis onto which components and small hardware items are to be assembled in a sequence of assembly steps to form an article;

(d) online providing a plurality of components to be assembled on said chassis;

(e) online placing a first component on said chassis;

(f) online presenting a first segment of said populated hardware dispensing substrate, said first segment having at least one small hardware item fastened thereon;

(g) successively withdrawing, each one of said at least one small hardware items from said first segment and installing said item on said chassis, thereby securing said first component; and (h) thereafter and in the same manner successively mounting other components on said chassis, while advancing said hardware presentation substrate to present successive segments accordingly to install other components, thereby completing assembly of said article.

2. The method of claim 1 wherein said flexible rectangular band is formed of a plastic or a smooth fiber material.

3. The method of claim 1 wherein said flexible rectangular band is mounted on a rigid frame.

4. The method of claim 1 wherein said hardware items are screws, bolts, or other threaded items.

5. The method of claim 4 wherein said mounting feature is a circular hole, having a diameter less than the major diameter but greater than the minor diameter of the thread of said screw, bolt, or other threaded item, punched into said band with at least three and preferably four cuts in said band emanating radially from said hole, thereby forming three or four relieves.

6. The method of claim 1 wherein said hardware items are washers, spacers, bearings, gears, covers, or other circular and essentially flat items.

7. The method of claim 6 wherein said mounting feature comprises at least two opposing tabs, cut into said band and arranged in a manner that when pulled upward, the hardware item is placed between them and after releasing said tabs the item is held in place by said tabs.

8. The method of claim 1 wherein one of said plurality of hardware items is a pin.

9. The method of claim 8 wherein said mounting feature comprises two opposing tabs, cut into said band and each tab having a hole greater than the diameter of said pin said tabs arranged in a manner that when pulled upward said pin is inserted through both holes and secured by said tabs after they are released.

10. The method of claim 1 wherein one of said plurality of hardware items is a stud.

11. The method of claim 10 wherein said mounting feature comprises at least two opposing tabs spaced to grasp the head of said stud, cut into said band and a hole in said band between said tabs having a diameter greater than that of the shaft of said stud but less than the diameter of the head of said stud.

12. The method of claim 1 wherein each one of said segments may contain more than one hardware item but all the items in the same segment must be identical in both form and dimensions.

* * * * *